United States Patent [19]

Yu et al.

[11] Patent Number: 4,796,536

[45] Date of Patent: Jan. 10, 1989

[54] CHAFF DISPENSER SYSTEM

[75] Inventors: Edward K. Yu, Newark, Calif.; David W. Rogers, Spokane, Wash.

[73] Assignee: Acurex Corporation, Mountain View, Calif.

[21] Appl. No.: 65,509

[22] Filed: Jun. 23, 1987

[51] Int. Cl.[4] ..... F42B 13/00

[52] U.S. Cl. ..... 102/505; 102/357; 342/12

[58] Field of Search ..... 102/340, 342, 351, 357, 102/401, 371, 504, 505; 342/12

[56] References Cited

U.S. PATENT DOCUMENTS

| | | | |
|---|---|---|---|
| 3,626,415 | 12/1971 | Montgomery | 102/505 |
| 4,350,315 | 9/1982 | Pollin | 244/3.1 |
| 4,517,896 | 5/1985 | Billard et al. | 102/342 |
| 4,580,500 | 4/1986 | Fauvel et al. | 102/401 |
| 4,683,824 | 8/1987 | Gibbs | 102/505 |
| 4,690,350 | 9/1987 | Grosso et al. | 244/3.1 |

*Primary Examiner*—Harold J. Tudor

*Attorney, Agent, or Firm*—Flehr, Hohbach, Test, Albritton & Herbert

[57] ABSTRACT

A system for chaff deployment which includes a compartmentalized platelet with the bottom of the compartments formed by preformed releasable tang springs and the top of the compartment by a releasable door. The door is released to open the chamber and the tang springs are thereafter released to eject and deploy the chaff contained in the chamber.

7 Claims, 6 Drawing Sheets

CHAFF DISPENSER SYSTEM

The U.S. Government has certain rights to the claimed invention pursuant to contract number F04704-83-C-0024.

This invention relates generally to a chaff dispensing system and more particularly to a chaff dispensing system capable of providing a cloud of dipoles of predetermined configuration.

In the field of strategic penetration an important aspect is effective radar masking of the reentry vehicles and/or decoys. One method of masking is the application or deployment of conductive dipoles (chaff) in the area of the vehicle or decoy to be masked from the radar. The result is a radar cross-section that is greater than that of the vehicle or decoy thereby preventing the discrimination of an object inside the cloud. In theory optimal masking is achieved by tuning the dipole lengths to one-half the wavelength of the radar frequency and spacing the deployed dipoles at least one wavelength apart. There are varying theories with respect to the cloud shape and dipole velocity distribution within the cloud.

All solutions attempted so far are stochastic in nature, i.e., the cloud characteristics are dependent on the random interaction of moving dipoles in space. This approach cannot be tailored to provide any specific cloud characteristic or formation.

It is an object of the present invention to provide an improved chaff deployment system.

It is another object of the present invention to provide chaff deployment systems in which the chaff cloud characteristics can be predetermined.

It is still a further object of the present invention to provide a chaff deployment system in which the chaff cloud shape and deployment can be designed into the system.

It is still a further object of the present invention to provide a chaff deployment system which is simple in construction and reliable in operation.

The foregoing and other objects of the invention are achieved by a chaff deployment system in which the chaff is carried in compartments of a compartmentalized multi-compartment platelet, releasable tang springs held in tension form the bottom of the compartment and the releasable doors close the top of the compartment. Means are provided for releasing the doors and means are provided for thereafter releasing the tang springs so that after the doors have been opened the chaff is propelled by the tang springs out of the compartments into the surrounding space.

The invention will be more clearly understood from the following description read in conjunction with the accompanying drawings of which:

Figure 1:
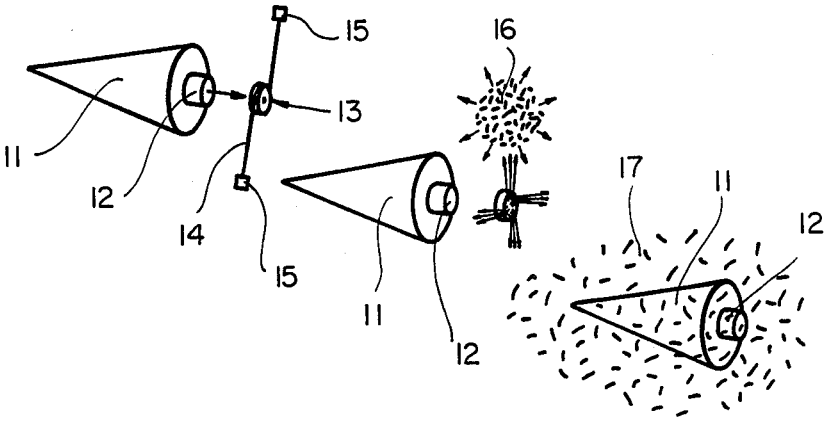
FIG. 1 is a schematic diagram showing a re-entry vehicle at various stages of deployment of the chaff.

Referring to FIG. 1, a re-entry vehicle or decoy 11 is shown in three positions to illustrate the deployment of chaff. The vehicle includes a canister 12 which houses a chaff deployment platelet 13 which is ejected at a particular position in the vehicle projectory.

When the platelet is ejected it is spinning at the same rate as the vehicle. it is desirable to control the rotational velocity of the platelet to control the pattern of the chaff dipoles. For this purpose a steel cable 14 with weight 15 is wound on the platelet and unwinds when the platelet is ejected from the canister thereby slowing the rotational velocity of the platelet. The length of the cable and the size of a weight attached to the cable will slow the rotational velocity of the platelet to achieve the desired platelet spin rate. In addition to despin the cable serves as a time delay mechanism and as it unwinds will, at a point in the unwinding, release or trigger the deployment of the chaff dipoles. The chaff dipole cloud deployment is schematically illustrated at 16 and the fully deployed cloud is shown at 17.

In order to sufficiently mask a hard body, the platelet must be first deployed and move a certain distance away from the canister 12. The platelet 13 is ejected from the canister 12 at a predetermined speed after which the deployment of the dipoles occurs.

Figure 2:
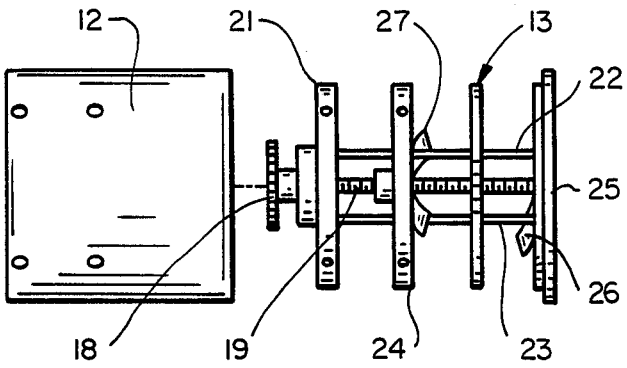
FIG. 2 is an enlarged exploded view of the platelet canister and platelet projecting apparatus.

FIG. 2 is an exploded view of the canister 12, the platelet and the platelet ejector assembly. The canister includes a motor (not shown) which drives gear 18 attached to a lead screw 19 supported by the base 21. A pair of parallel guide rods 22 and 23 are also supported by the baseplate 21 and serve to guide the platelet 13. Cover plate 25 and a pusher plate 24 are threadably received by the lead screw and is restrained from rotation by the guides 22 and 23 whereby they move linearly along the guides as the screw is rotated. Thus energization of the motor drives gear 18 and lead screw which moves the cover plate 25 until it releases from the lead screw and guide rods. A spring 26 ejects the cover outwardly away from the canister. The pusher plate 24 and the platelet are driven towards the end of the guide rods and lead screw. The pusher plate includes a U-shaped spring 27. When the platelet is released from the end of the lead screw, the spring 27 ejects the platelet away from the canister so that it travels away from the canister and vehicle.

Figure 3:
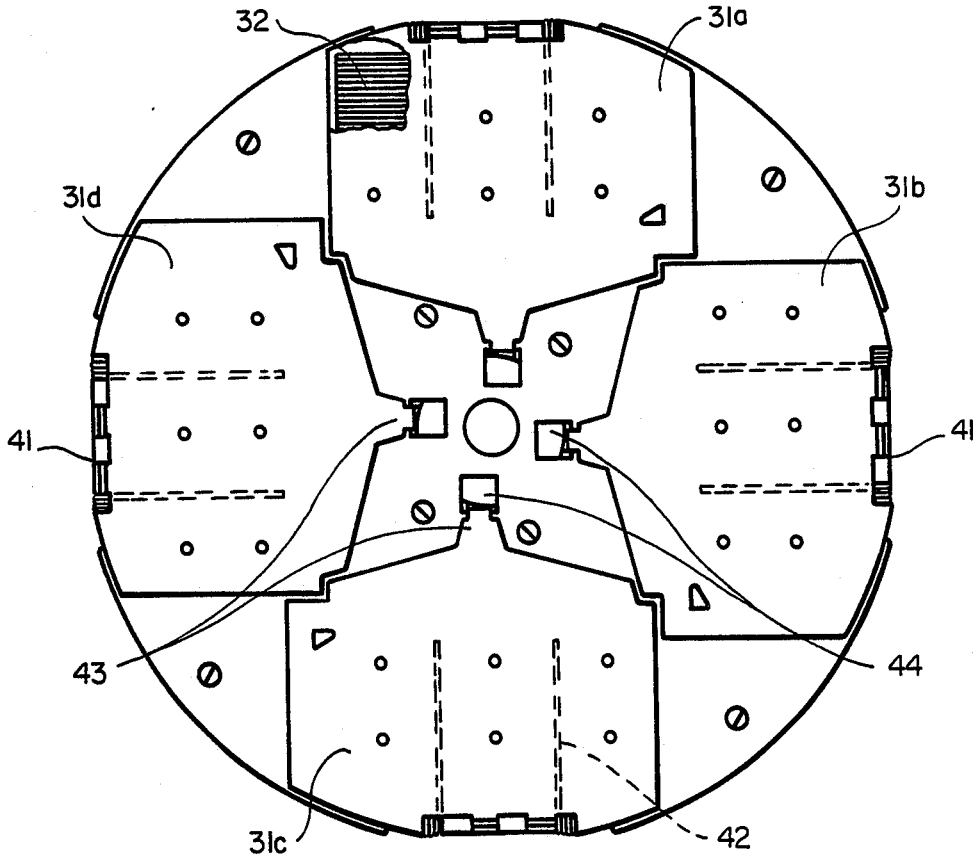
FIG. 3 is a top plan view of a platelet in accordance with the invention.
Figure 6:
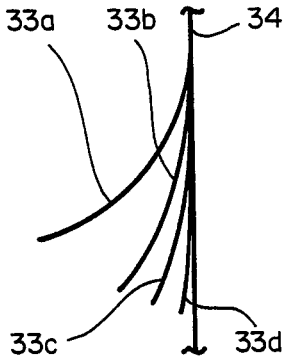
FIG. 6 is a side elevational view of the tang springs shown in FIG. 5 in their released position.
Figure 7:
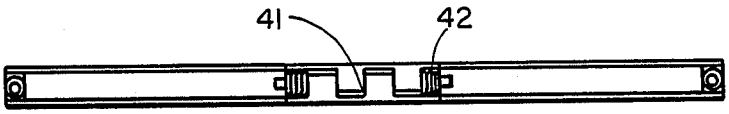
FIG. 7 is a side elevational view of the platelet assembly.
Figure 8:
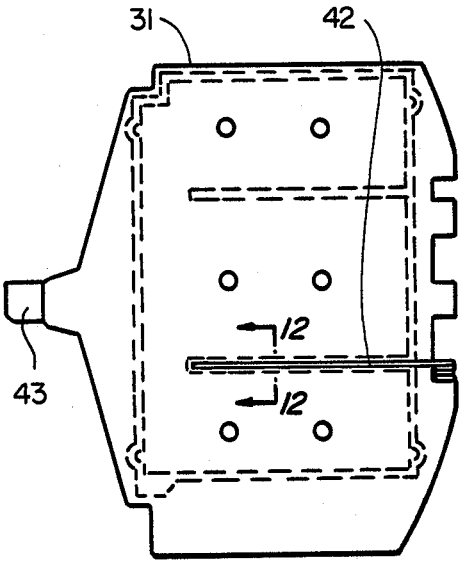
FIG. 8 is a top plan view of bottom door assembly.
Figure 10:
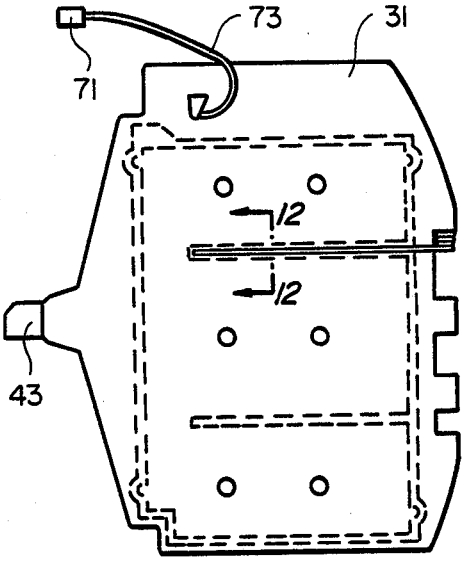
FIG. 10 is a top plan view of a top door assembly.
Figure 9:
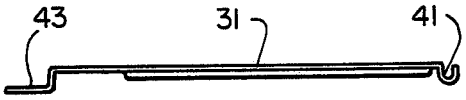
FIG. 9 is a front elevational view of the door assembly of FIG. 8.
Figure 15:
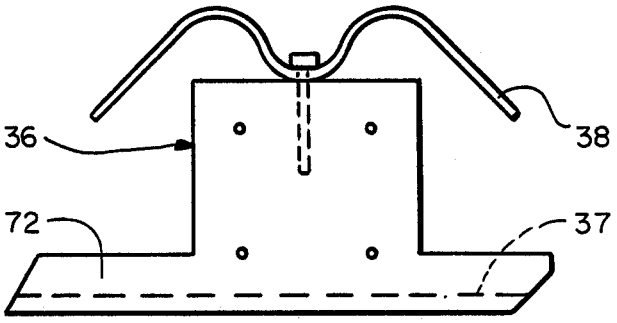
FIG. 15 is a top plan view of a tang spring retainer.
Figure 16:
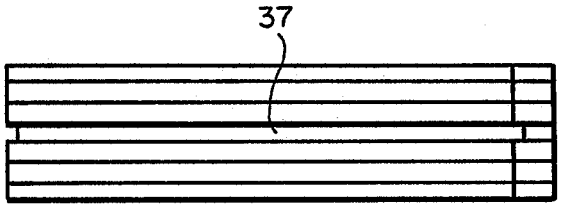
FIG. 16 is a front elevational view of the retainer of FIG. 15.
Figure 17:
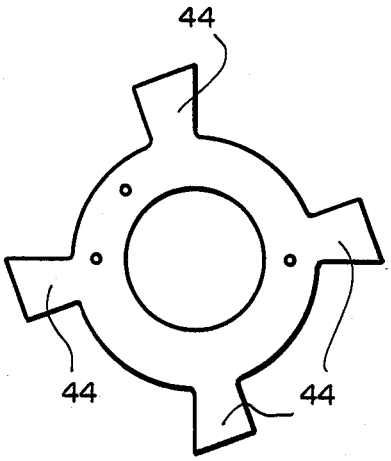
FIG. 17 is a top plan view of a door holding detent.
Figure 18:
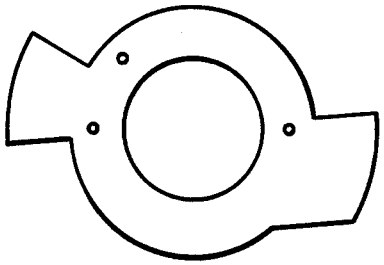
FIG. 18 is a top plan view of a ball driver.

A platelet assembly is illustrated in FIGS. 3–7. The platelet assembly includes eight identical dipole chambers which are adapted to receive and hold the chaff dipoles. Referring to FIG. 3, the upper chambers are shown covered by spring loaded doors 31*a*–31*d*. The door 31*a* is shown broken away to illustrate the dipoles 32 housed within the chamber. The bottom of the chamber is provided with a plurality of tang springs 33*a*–33*d* which are formed in a plate 34, FIG. 5, forming part of the assembly. The springs are retained in the flat tensioned position by a plunger 36 which includes a groove on its front face to receive and hold the ends of the spring to thereby form a flat bottom in each of the chamber. The plunger is shown in more detail in FIGS. 15 and 16 and is comprised of a plurality of laminated plates defining a groove 37. A retracting spring 38 is secured to the back of the plunger and operates, as will be presently described, to retract the plunger and release the tensioned tang springs. Referring to FIG. 6, the normal curvature of the spring tangs 33*a*–33*d* is shown. This is the position to which the tangs will spring when released. When the tangs spring outwardly as shown they serve to eject the chaff dipoles from the chamber into the surrounding space.

Figure 13:
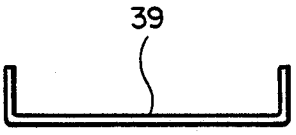
FIG. 13 is a side elevational view of a compartment divider used in connection with the tang springs.
Figure 14:
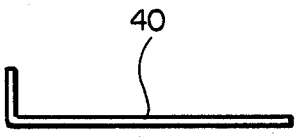
FIG. 14 is a side elevational view of another divider used with the tang springs.

The chamber is compartmentalized by U-shaped and L-shaped dividers 39 and 40 as shown more clearly in FIGS. 13 and 14. Thus, the dipoles 32 are aligned with one another and separated into four regions in each of the platelet compartments.

Figure 20:
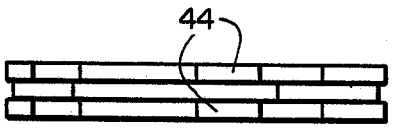
FIG. 20 is a side elevational view of the assembly shown in FIG. 19.

The upper doors 31*a*–31*d* and their corresponding lower doors are hinged to one another by the hinges 41 and include coil springs which have extending arms 42 secured to each of the doors. The springs 42 are tensioned so that they will open the doors as soon as the doors are unlatched. In the closed position of the doors, the door tabs 43 are retained by corresponding outwardly extending door detents 44 in the actuator nut assembly, FIG. 20. Upon rotation of the actuator nut, the tabs are released, the upper and lower doors will spring open and away from the platelet allowing the chaff dipoles to be projected outwardly into space. The mechanism for accomplishing the foregoing will be presently described.

Figure 4:
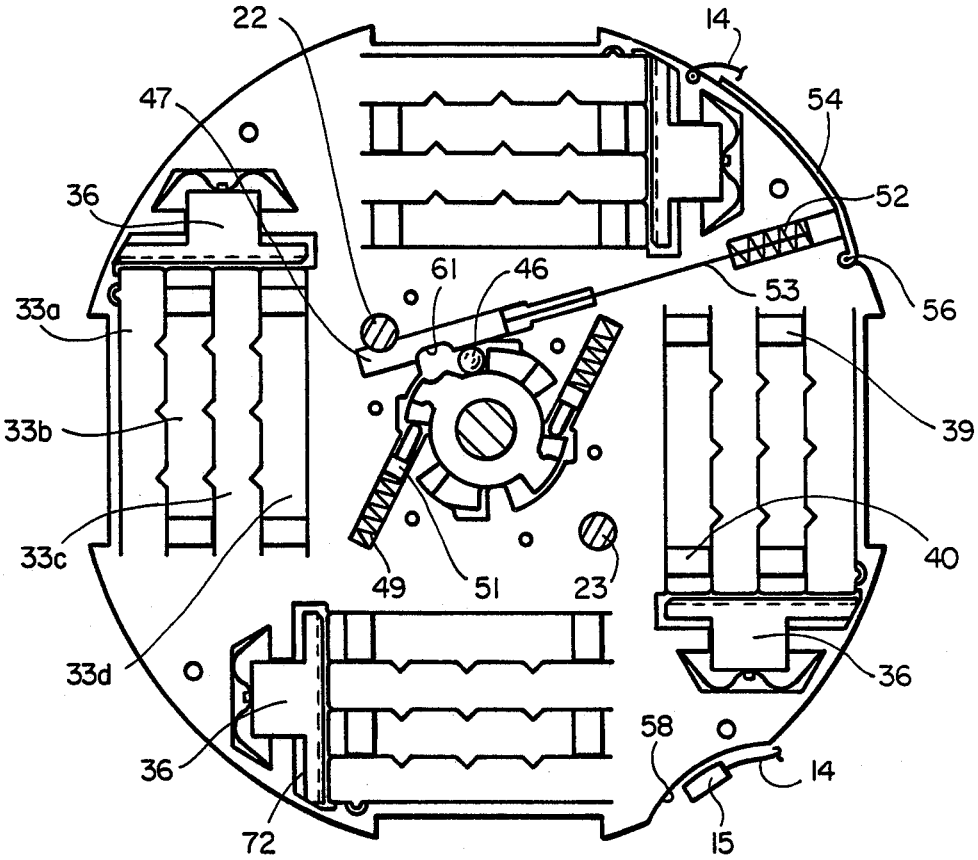
FIG. 4 is a sectional view of a platelet showing the layer having the tang springs.
Figure 5:
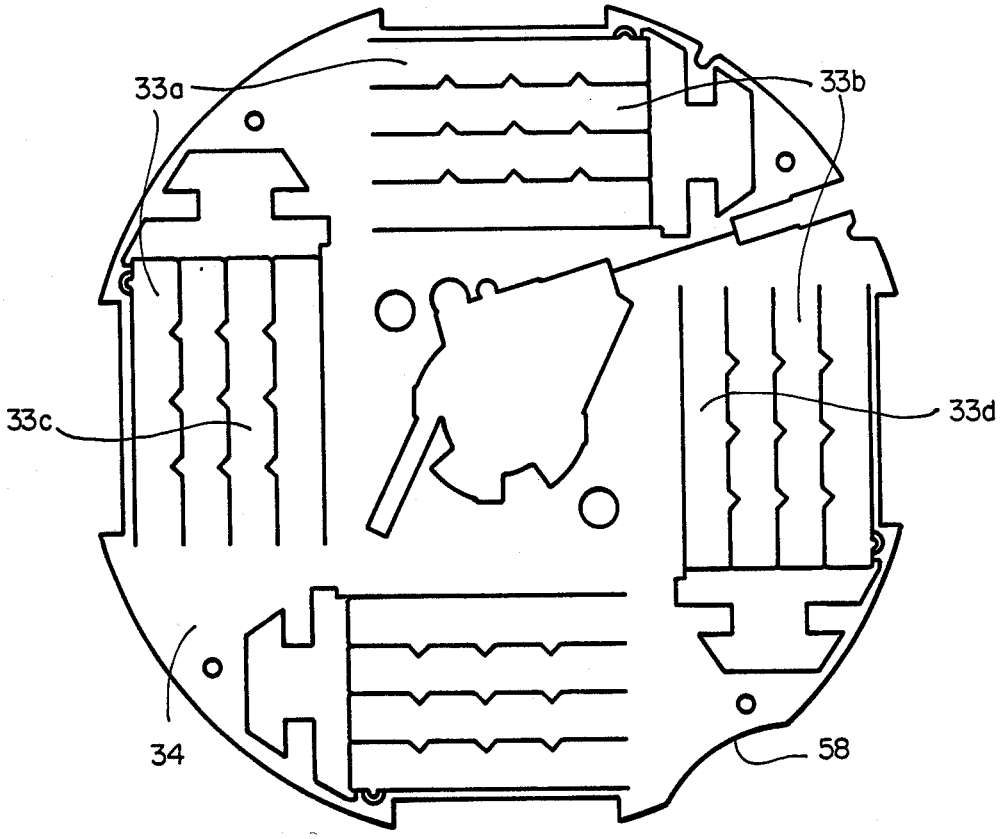
FIG. 5 is a top plan view of the tang spring layer.

Referring particularly to FIG. 4, the actuator nut assembly is locked in position by a ball 46 which is held by plunger 47. The plunger is retained in position by the guide rod 22. In this position the springs 49 associated with drivers 51 are in compression. Spring 52 associated with the rod 53 connected to plunger 47 is held under compression by means of a lever 54 pivoted to the platelet at 56. The lever 54 is held in position by the wire 14 which is wound one or more turns around the periphery of the platelet and is provided with a weight 15 for the purpose of providing the proper despin and time delay. The weight 15 is retained in the detent 58. When the platelet is in the canister to thereby maintain the wire wound onto the platelet.

Figure 19:
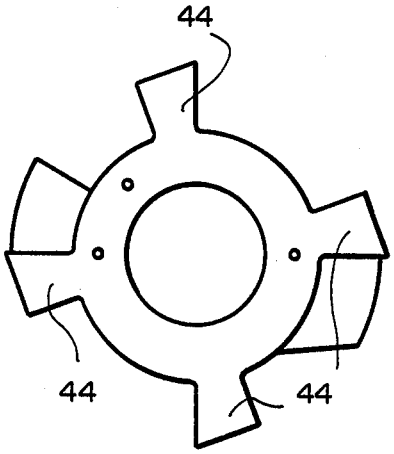
FIG. 19 is a top plan view of a door detent and ball driver assembly.

As previously described, when the platelet is ejected from the canister the wire 14 with weight 15 unwinds to slow down and control the spin rate of the platelet. Also, when the wire has fully unwound it releases the lever 54 which allows the spring 52 to expand and pull the plunger 47 outwardly since it was freed from guide 22 when the platelet was ejected. As the plunger moves out, the ball 46 rides into the recess 61 formed in the plunger. This allows the springs 49 to drive the drivers 51 against the actuator nut assembly projections and causes the nut to rotate. This releases the door tabs permitting the doors to spring open. The timing of this action is controlled by the length of the wire which is wound onto the platelet and by the weight attached thereto. The actuator nut assembly illustrated in FIGS. 19 and 20 includes upper and lower door detent sections and a central driver section.

Figure 11:
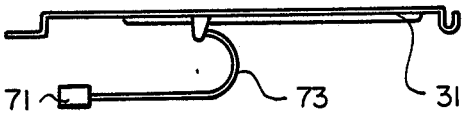
FIG. 11 is a front elevational view of the door assembly of FIG. 10.
Figure 12:
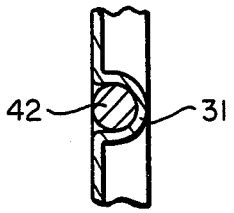
FIG. 12 is a sectional view along line 12 of FIGS. 8 and 10.

To assure that the dipoles are not ejected prior to a full opening of the doors, the plunger 36 is held in the locked position by a block 71, FIG. 11, inserted between the platelet housing and the back 72 of the plunger. The block 71 is attached to a wire 73 which is of such length that the block is not removed until the door has swung fully open to clear the space above the compartment at which time the block 71 is removed and the spring 38 retracts the plunger 36 and releases the tang springs which then spring into the position shown in FIG. 6. This ejects the dipoles, from each of the subcompartments, a distance depending upon the bend in the particular tang spring. In the example the outer dipoles are projected further than the inner dipoles. The dipoles in each compartment fill one-eighth of a sphere with each subcompartment filling one-thirtysecond of the spherical space. By appropriately adjusting the bend of the tang springs the shape and size of the cloud of dipoles can be controlled.

Thus there has been provided an apparatus for deploying dipoles in space in which the time of deployment of the dipole cloud is controlled by adjusting the length and weight of a despin cable assembly. The velocity and spatial distribution of the cloud is controlled by the bending of tang springs whereby they are placed under preset tension to release and eject the dipoles and the action of the springs in conjunction with the spin of the platelet determine the shape of the cloud.

We claim:

1. A chaff deployment system including a platelet, a plurality of compartments formed in said platelet, said compartments each including a bottom defined by a plurality of preformed tang springs and a top formed by a door whereby upon release of the door followed by release of the tang springs, chaff contained in the compartments is propelled out of the compartment with predetermined direction and velocity.

2. A chaff deployment system including a platelet, a plurality of compartments formed in said platelet which each include a bottom defined by plurality of preformed tang springs and a top formed by a spring loaded door, means for releasably holding said door in a closed position, means for releasing said door holding means whereby the door springs open and chaff disposed in said compartment is ejected by said tang springs with predetermined direction and velocity.

3. A chaff deployment system as in claim 2 including means for engaging and releasably holding said tang springs and means for releasing said tang spring holding means after the door has opened to assure the door is clear of the compartment when the chaff is ejected.

4. A chaff deployment system for use with a reentry vehicle comprising a chaff platelet, a canister for holding said chaff platelet, means for ejecting said platelet from said canister, a plurality of compartments formed in said platelet, preformed tang springs disposed to form the bottom of each of said compartments, a door forming the top of each of said compartments, means for releasably holding said door, means for releasing said door a predetermined time after the platelet has left the canister, said door opening the top of said compartment to allow the tang springs to eject chaff carried in said compartment.

5. A chaff deployment system as in claim 4 including means for engaging and releasably holding said tang springs and means for releasing said tang spring holding means after the door has opened to assure the door is clear of the compartment when the chaff is ejected.

6. A chaff deployment system for use with a reentry vehicle comprising a chaff platelet, a canister for housing said platelet, said canister including a drive screw and guide means for receiving, guiding and driving said platelet to eject the platelet from the canister, a cable wound on said platelet whereby it unwinds to slow the rotational velocity of the platelet, a plurality of compartments formed in said platelet, preformed tang springs disposed at the bottom of each of said compartments, means for engaging and holding the ends of the tang springs at the bottom of each of said compartments, a door for each compartment forming when closed a top for said compartment, spring means for opening said doors, rotatable means for engaging and holding each of said doors in the closed position, means including spring means for rotating said rotatable means, means for holding said rotatable means in engagement with the doors, means for releasing said rotatable means holding means after a predetermined time whereby the rotatable means is rotated to release the associated door, means cooperating with each of said doors for releasing the tang spring holding means whereby they eject chaff out of the compartment.

7. A chaff deployment system as in claim 6 in which said means for releasing said rotatable holding means includes said cable.

* * * * *